US006206168B1

(12) United States Patent
Hendricks

(10) Patent No.: US 6,206,168 B1
(45) Date of Patent: Mar. 27, 2001

(54) SIMPLIFIED COIN-CONTROLLED LATCH UNIT

(75) Inventor: Robert Hendricks, Youngstown, OH (US)

(73) Assignee: Steel City Corp., Youngstown, OH (US)

( * ) Notice: Subject to any disclaimer, the term of this patent is extended or adjusted under 35 U.S.C. 154(b) by 0 days.

(21) Appl. No.: 09/428,148

(22) Filed: Oct. 27, 1999

(51) Int. Cl.[7] ..... G07F 1/04
(52) U.S. Cl. ..... 194/346
(58) Field of Search ..... 194/346, 200; 379/150, 151, 152, 153

(56) References Cited

U.S. PATENT DOCUMENTS 4,630,624 * 12/1986 Turner ..... 194/346
4,841,563 * 6/1989 Sano et al. ..... 379/150
4,860,345 * 8/1989 Mellon ..... 379/150
5,036,966 * 8/1991 Kaspar et al. ..... 194/346
5,381,880 * 1/1995 Pearson ..... 194/346

* cited by examiner

*Primary Examiner*—Robert P. Olszewski
*Assistant Examiner*—Bryan Jaketic
(74) *Attorney, Agent, or Firm*—Robert Lev

(57) ABSTRACT

A simplified, compact coin-controlled coin latch unit includes a latching arm and a deactivating arm, arranged on the same pivot. The operation of the deactivating arm, which is controlled by the opening and closing of the door latched by the latch unit, operates a magnetic switch which deactives the solenoid which controls the latching arm. The deactivating arm also controls a hinged flap which forms part of a temporary coin receptacle. When the door opens, the deactivating arm is released, deactivating the solenoid and releasing the hinged flap to permit coins to fall into a chute to a permanent coin receptacle. When the door is closed, the deactivating arm is moved to it's original point, closing the hinged flap and activating the magnetic switch to close, thereby permitting reactivation of the solenoid circuit, in response to a coin detecting device.

13 Claims, 3 Drawing Sheets

SIMPLIFIED COIN-CONTROLLED LATCH UNIT

TECHNICAL FIELD

The present invention relates generally to a door latching mechanism such as that used in a coin-controlled newspaper vending machine. In particular, the present invention is directed to a simplified door latching mechanism that can be controlled both electrically and mechanically.

BACKGROUND ART

Various types of coin-controlled latching mechanisms are used to control the doors of conventional dispensing units. The most common type of door-operated device is the newspaper vending machine. Conventionally such machines have detected correct coin denominations and numbers of coins using mechanical devices calibrated for the size of the coins and their overall weight.

A typical example of such a machine is disclosed in U.S. Pat. No. 3,253,690 to Brewton et al., incorporated herein by reference. In this device, the proper weight of coins inserted into the machine triggers a spring which releases a door latch, allowing the door to be opened and a newspaper to be retrieved by the customer.

Like all such vending devices, the mechanical elements that are used to open the door are moderately complex, and require constant maintenance due to normal wear or extraordinary abuse. Further, the relatching of the door also depends upon movement of the coins so that any hindrance of this movement could cause the door to remain unlocked even after it has been closed.

Upgraded versions of many vending machines use electronic coin detectors. These are usually used to trigger a switch activating a solenoid, which operates a latch to release the door so that the products behind the door can be accessed by the customer. Even with an electronic coin detecting device and the use of a solenoid to operate a latch releasing the door, overall conventional mechanical devices are complex and, thus are prone to failure.

Consequently, there exists a substantial need in the vending machine art for a simplified mechanical device that can be operated by either mechanical or electronic coin detection devices.

SUMMARY OF THE INVENTION

Consequently, it is an object of the present invention to rectify the drawbacks of the conventional art.

It is another object of the present invention to provide a simplified mechanical door latch release mechanism for vending machines.

It is a further object of the present invention to provide a door latching mechanism that is highly compact, thereby permitting a decrease in the overall size of an associated vending machine.

It is an additional object of the present invention to provide a fail safe mechanism by which the door of an associated vending machine will be relatched after it has been opened.

It is still another object of the present invention to automatically divert coins to correct locations upon operation of the door with respect to the door latching mechanism.

It is yet an additional object of the present invention to provide a vending machine control mechanism that is easily adjustable.

These, as well as other goals and objects of the present invention, are achieved by a door latching and coin handling mechanism activated by a coin detecting device. The door latching and coin handling mechanism include a temporary coin receptacle constituted by two hinged flaps arranged in a V-shaped formation. A pivoting latch arm is arranged to hold the door. The latch arm is mounted on a first pivot and driven by a solenoid. A deactivating device is arranged to deactivate the solenoid and control the temporary coin receptacle in order to place the coins in a permanent coin holder. The deactivating device includes a first deactivating arm arranged on the same pivot as the latch arm.

A second aspect of the present invention is provided by a method of operating a coin-controlled latching mechanism arranged to interface with a door locking structure. The latching mechanism includes a coin detector. Also included is a latching arm and an activating arm on a common pivot. The method includes the steps of detecting for a predetermined coin value and operating the solenoid to raise the latching arm and release the locking structure in response to detecting a predetermined coin value. Immediately responsive to the operation of the solenoid the door is opened. Upon opening the door a number of additional substeps are carried out. These include moving the deactivating arm on the pivot and responsive thereto operating a magnetic switch. Upon operating the magnetic switch, the solenoid is deactivated. As soon as the solenoid is deactivated the latching arm rotates on it's pivot into a locking position. Further, immediately upon the initial operation of the deactivating arm, the coin from a temporary coin receptacle are released into a permanent coin holder.

DETAILED DESCRIPTION OF THE PREFERRED EMBODIMENTS

Figure 1:
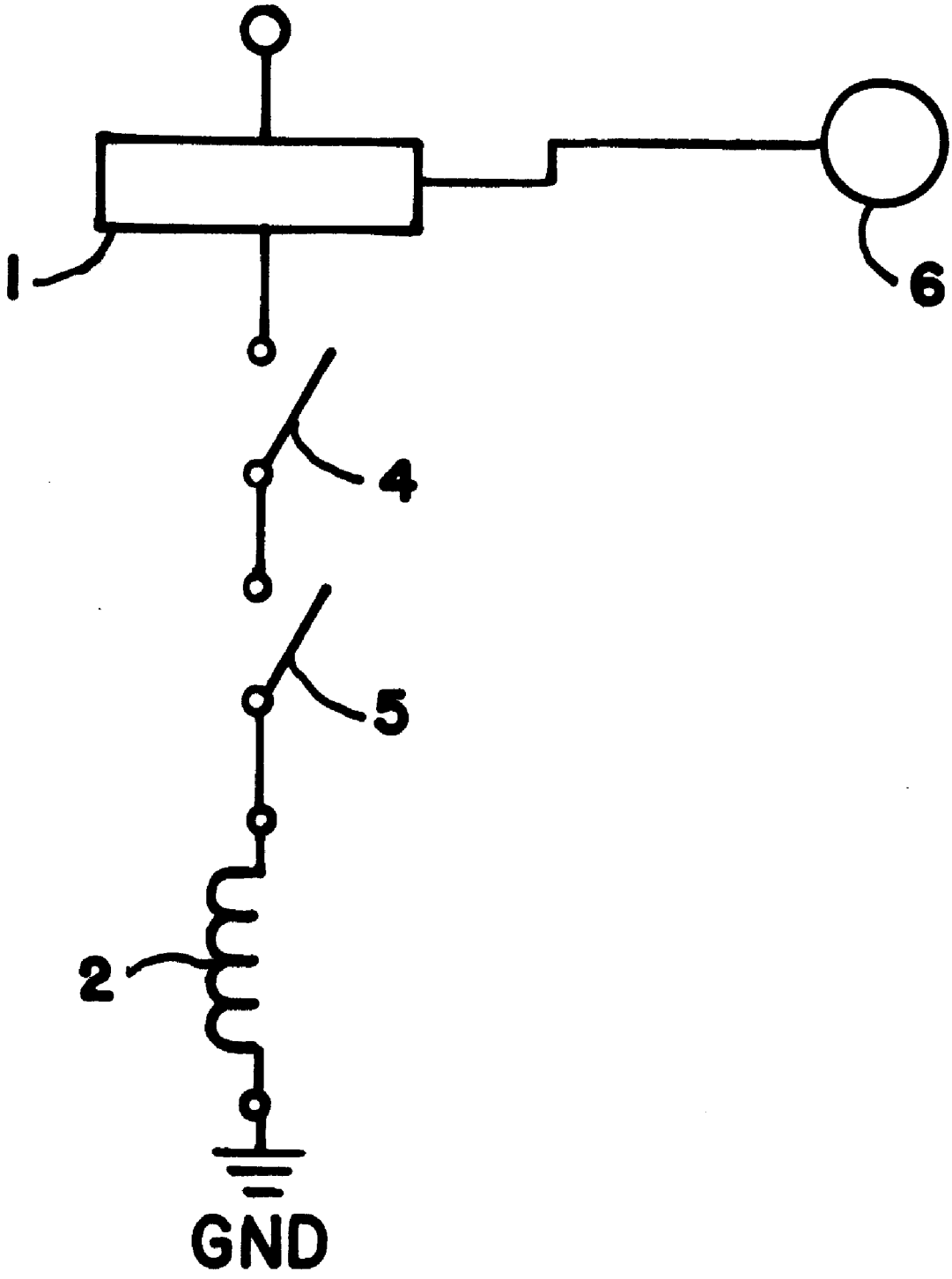
FIG. 1 is an electrical schematic depicting the functional operation of the present invention.

FIG. 1 depicts a functional arrangement of the present invention as exemplified by its electrical operation. At the top of the diagram the "+" depicts the positive electrical potential necessary for the operation of both electronic coin detector 1 and solenoid 2. The complete circuit between the positive potential and the ground which is necessary to activate solenoid 2 can be broken by switch 4 and a temporary contacts 5 operated by the coin return lever.

The operation of the electronic coin detector can be adjusted by way of a key switch 6, which is used to change the denominations of the coins required by the coin detector. This function is carried out by using mechanical switching of preprogramming switches on a microprocessor. This key-operated function is particularly useful when changing the vending machine operation between the handling of daily papers and Sunday papers.

It should be noted that temporary contacts 5, activated by the coin return lever (depicted as 51 in FIG. 2), can be eliminated without substantially altering the operation of the present invention. The use of a coin return lever is well-known in the conventional art. The use of temporary contacts to temporarily deactivate the solenoid is merely an additional fail safe in the operation of the present invention.

On the other hand, switch 4 is crucial to the operation of the present invention in that the switch deactivates the solenoid entirely once the door has been opened. In this manner, the solenoid can only be reactivated when the door is once again closed, operating the magnetic switch for another time. The second operation of the switch will close it, thereby allowing the solenoid to be deactivated. Preferably switch 4 is a magnetic switch, which is opened and closed by the proximal movement of a ferrous body. Such switches and their alternate open-close operations are well-known in the switching art. However, other types of switches can be used in the present invention.

Preferably, the present invention utilizes an electronic coin detecting and counting device 1. Many such devices are already well-known in the conventional art and need no further elaboration for purposes of the present invention. However, an electronic coin detecting and counting device is not necessary to the operation of the present invention. Rather, any kind of well-known mechanical coin detection device can be used to trigger a switch (substituted in place of an electronic detector 1 in the circuit depicted in FIG. 1) that will complete a circuit allowing activation of solenoid 2.

Figure 2:
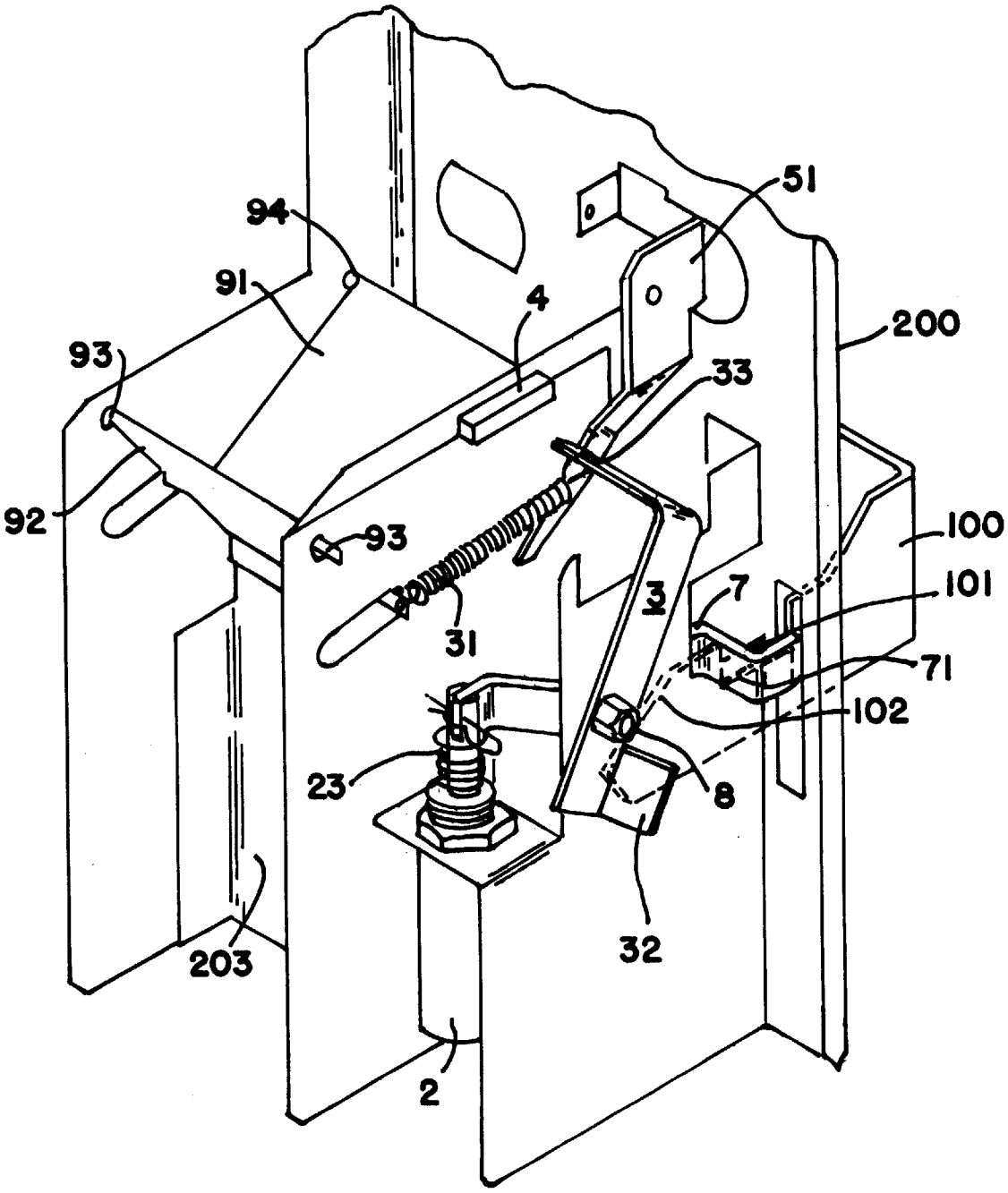
FIG. 2 is a perspective diagram depicting all of the elements necessary for the operation of the present invention.

The proper operation of magnetic switch 4 is facilitated by the movement of deactivating arm 3 (as depicted in FIG. 2). A distal end 33 of deactivating arm 3 moves proximally to magnetic switch 4 when the door to the vending machine (not shown) is opened, and when it is closed again. This movement of the deactivating arm 3 is facilitated by locking structure 100 which is formed as an integral part of the door (not shown).

The locking structure 100 serves two purposes. When latching arm 7 is moved downwards, an extension 71 of the latch arm fits into notch 101, thereby holding the door closed by virtue of holding the locking structure 101. In the closed position, a slanted surface 102 of locking structure 100 pushes against deactivating arm 3, holding it outward. When in this position, the distal end 33 of the deactivating arm 3 is held forward (as depicted in FIG. 2) and away from magnetic switch 4. Further, when in this position the deactivating arm stretches spring 31, which is attached to the distal end 33 on one end of the spring and to a first hinged flap 92 at the other end of the spring.

When the door is closed, and the latch arm is held in the aforementioned position (position A in FIG. 3), the tension of spring 31 holds the second hinged flap 92 against a first hinged flap 91. These two hinged flaps form a temporary V-shaped coin receptacle, which receives coins dropped into a slot (not shown) on front of panel 200. While the first hinged flap 92 is controlled by spring 31, and thus by deactivating arm 3, the first hinged flap 91 is controlled by coin return release handle 51 which forces the free end (opposite hinge 94) the second hinged flap 91 forward and downward when activated. Preferably, the second hinged flap 91 is spring-bias to hold it against the first hinged flap 92. As a result, once the coin release handle 51 is released, the spring bias will force the first hinged flap back into the position whereby it forms a V-shaped structure with the first hinge flap 92.

When the two hinged flaps 91 and 92 form a V-shaped structure, the apex of the V is at a partition 203 between a chute 201 to a permanent coin holder (not shown) and coin return area 202. The return coin area 202 is accessible by the customer for retrieval of coins originally placed in the machine.

Figure 3:
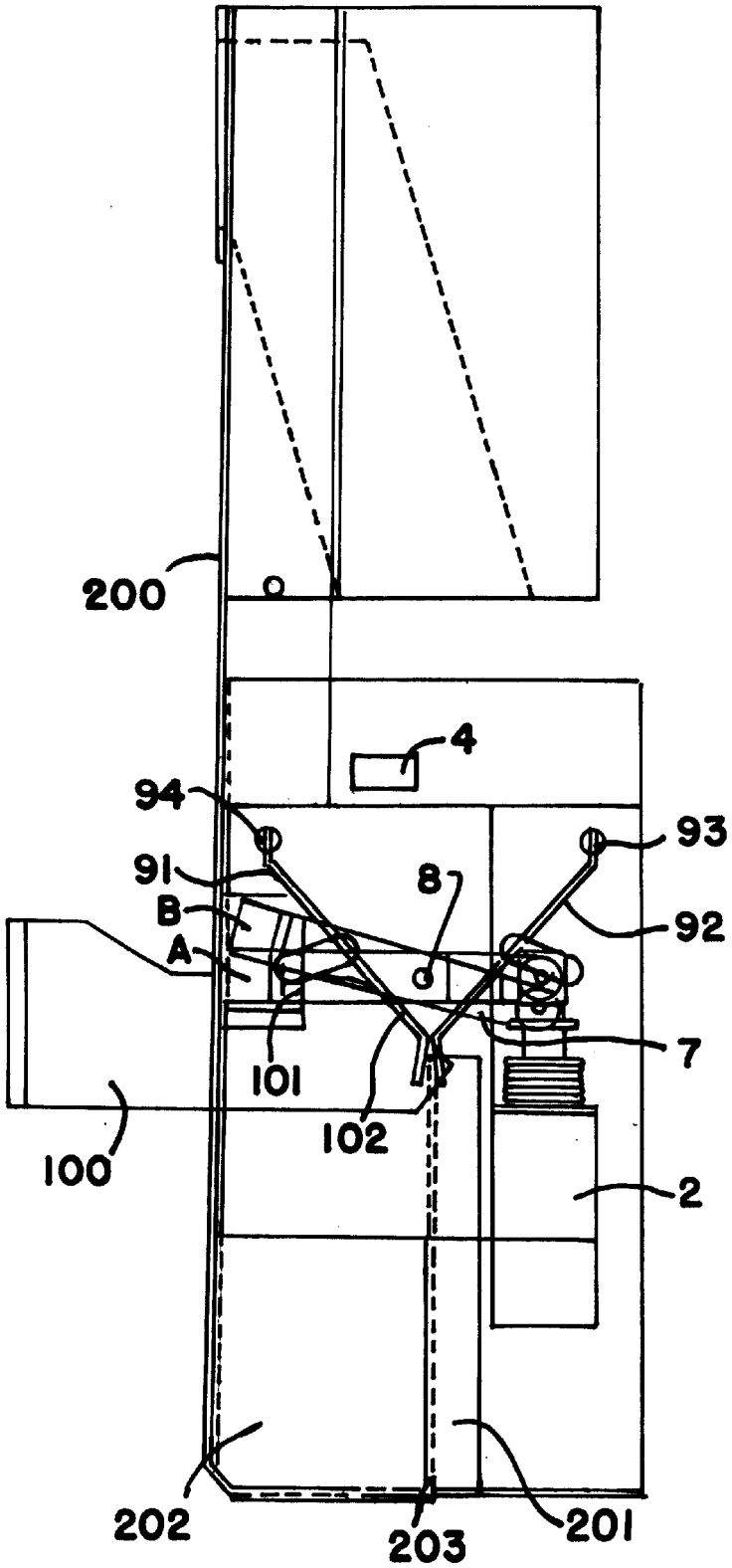
FIG. 3 is a partial side view diagram depicting only certain elements of the present invention.

In a normal operation the present invention is best understood by reference to FIGS. 1, 2 and 3. In functional terms, as depicted in FIG. 1, switch 4 is normally closed, as is coin return switch 5 when the door is closed (and locking structure 100 extended). Only the switching elements contained within coin detector 1 remains open. The detection of the proper number and denomination of coins inserted into the machine will create a closed circuit through coin detection device 1 thereby activating solenoid 2. As previously discussed, the activation of the solenoid raises latching bar 7, freeing it from notch 101 in locking structure 100. This would permit the door (not shown) to be pulled open so that a customer can access the goods contained in the enclosure (not shown) secured by the door.

FIG. 3 is a partial side view in which deactivating arm 3 is not depicted, for the sake of simplicity. At the beginning of the operation latching bar 100 is in the position shown and is held in place by pivoting latch arm 7. An extension 71 of the pivoting latch arm fits into a notch 101 in the first of two positions (A, B, respectively) depicted in FIG. 3. The position of locking bar 100 when the door is closed is also depicted in phantom in the perspective view of FIG. 2. The locking bar 100 forces deactivating arm 3 into the position depicted in FIG. 2. This is accomplished by the beveled edge 102 of locking structure 100 being forced against extension 32 at one end of deactivating arm 3. It should be noted that for simplicity of operation of the overall device deactivating arm 3 is pivoted at the same point 8 as is the pivoting latch arm 7. This arrangement results in a much simpler and more compact arrangement than is found in the conventional art. This simplicity and reduced size constitute one of the major advantages of the present invention.

The second end of deactivating arm 3 is formed at a 90° angle as depicted in FIG. 2, and has a distal end 33 which attaches to spring 31. When forced into the position depicted in FIG. 2 by locking structure 100, the deactivating arm 33 is positioned to stretch spring 31, which is attached to first hinged flap 92. The force of the extended spring 31 forces the far end (the one opposite hinge 93) of the first hinged flap 92 against a complementary distal end of hinged flap 91. These two flaps form a V-shaped structure with an apex occurring at partition 203 (best depicted in FIG. 3). The tension of spring 31 maintains sufficient pressure of the two hinged flaps 91,92 against each other so as to maintain a temporary coin receptacle within the V-shaped structure formed by the two hinged flaps.

Partition 203 serves to separate a coin return area 202 from a chute 201 to a permanent coin receptacle (not shown). The coin return area 202 is provided with an access aperture (not shown) in frame 200. The permanent coin holder (not shown) which is connected to coin shoot 201 is constructed in a manner well-known in this technology, and needs no further elaboration for purposes of describing the present invention. Both of the hinged flaps 91,92 are supported by hinges, 94,93, respectively. Each is held in a position shown in FIG. 3 by a spring biasing mechanism. Flap 92 is held by the tension of spring 31 whereas the flap 91 is held by a spring (not shown) in a conventional manner. Hinged flap 91 can be released (moved downward) against the spring bias through the action of coin release lever 51, in a conventional manner.

When coin return mechanism 51 is operated by the customer, hinged flap 91 is forced downward allowing the coins that have accumulated in the temporary coin receptacle to slide into coin return area 202. From this position, the customer may access the coins and retrieve them. Ancillary contacts 5 can be added to the electrical circuit depicted in FIG. 1 to make certain that the solenoid cannot be activated when the coin return mechanism is in operation.

Such contacts are normally closed, and remain open only so long as the coin return lever 51 is depressed by the customer. The arrangement of such temporary contacts are well-known in this technology, and need no further elaboration for purposes of understanding the present invention.

Normally coin detection mechanism 1 is set to have a predetermined time delay of approximately 5 seconds during which solenoid 2 is activated and the door (not shown) can be opened due to the movement of pivoting latch arm 7 out of notch 101 (position B as depicted in FIG. 3). If after this time, the door is not opened, the solenoid is automatically deactivated by the opening of a switch in the coin detector A. At which point, the customer may activate coin return lever 51 to retrieve the coins previously inserted. The time delay can be altered by adjusting the electrical timing circuits of coin detection mechanism 1 in a conventional manner.

Once solenoid 2 has been activated, pivoting latch arm 7 pivots about pivot 8 as the solenoid moves downward against the tension of spring 23. The movement of the pivoting latch arm 7 into position B (as depicted in FIG. 3), release locking structure 100 so that the door (not shown) to which the locking structure is attached can be pulled open, and goods, such as newspapers, accessed by the customer. At the same time, deactivating arm 3 is released by the removal of beveled edge 102 so that the tension of spring 31 draws the distal end 33 of deactivating arm 3 back towards pivot 93. This action achieves two functions.

The first is to release hinged flap 92 so that any coins held in the temporary coin receptacle enter chute 201, and are conveyed to a permanent coin receptacle (not shown). The weight of the coins is sufficient to do this once the tension from spring 31 has been released.

The second action that occurs is that distal end 33 of deactivating arm 3 is moved past magnetic switch 4. This movement deactivates the switch, opening it's contacts so that the solenoid activation circuit as depicted in FIG. 1 is opened. Once deactivated, the solenoid 2 extends due to the spring pressure caused by compressed spring 23. This extension pivots latching bar 7 back into a position where it will latch locking structure 100. When the door (not shown) is closed, beveled edge 102 of the locking structure 100 slides under the extension 71 of latch arm 7, forcing the latch arm up temporarily so that extension 71 can be moved into notch 101 as locking structure 100 extends forward.

The forward extension of locking structure 100 caused beveled edge 102 to contact extension 32 of deactivating arm 3. As a result, deactivating arm 3 is moved against the tension of spring 31 until it reaches the position depicted in FIG. 2. As the deactivating arm is moved back into it's original position (with the door closed), the distal end 33 of the latching arm 3 is again moved past magnetic switch 4. This second pass of distal end 33 closes magnetic switch 4 thereby allowing the solenoid 2 to be activated once the coin detection device 1 detects the proper coins and provides power to the rest of the circuit depicted in FIG. 1. At this point, the device is in it's original position (with the door closed), and is ready to be operated again by the detection of the appropriate number and denomination of coins.

While at least one preferred embodiment has been described by way of example, the present invention is not limited thereby. Rather, the present invention should be construed to include any and all variations, permutations, modifications, adaptations and embodiments that would occur to one skilled in this art having been taught the instant invention. Accordingly, the invention should be defined only by the following claims.

I claim:

1. A door latching and coin handling mechanism activated by a coin detecting device, said door latching and coin handling mechanism comprising:

a) a temporary coin receptacle constituted by two hinged flaps arranged in a V-shaped configuration;

b) a pivoting latch arm arranged to hold said door, said latch arm being mounted on a first pivot and driven by a solenoid and, c) deactivating means for deactivating said solenoid and controlling said temporary coin receptacle to place coins in a permanent coin holder, said deactivating means having a first deactivating arm on said first pivot.

2. The mechanism of claim 1, wherein said deactivating means further comprise a switch arranged to de-energize said solenoid when said deactivating arm is moved.

3. The mechanism of claim 2, wherein said switch is a magnetic device, and is activated by movement of said deactivating arm proximal to said magnetic device.

4. The mechanism of claim 3, wherein said deactivating arm has a first end configured to interface with a locking structure integral with and extending perpendicular from said door, and said deactivating arm having a second end operatively connected to a first hinged flap of said temporary coin receptacle.

5. The mechanism of claim 4, further comprising a spring connected between said second end of said deactivating arm and said first hinged flap, and configured so that spring tension from said spring is exerted on said first hinged flap, keeping said first and second flaps together when said locking structure of said door is being latched by said latch arm in a locked.

6. The mechanism of claim 5, wherein said first hinged flap is released when said locking structure is removed by opening said door so that any coins in said temporary coin receptacle fall into a permanent coin holder.

7. The mechanism of claim 6, further comprising a coin release handle operatively connected to said second hinged flap, whereby the operation of said coin release handle moves said second hinged flap away from said first hinged flap dropping coins in said temporary coin receptacle into a coin return area.

8. The mechanism of claim 7, wherein second hinged flap is positioned by a spring bias to block said coin return area when said coin return handle is not activated.

9. The mechanism of claim 8, wherein said solenoid operates responsive to detection of a predetermined value of coins by said coin detecting device, whereby said solenoid activates to lift said latch arm, thereby releasing said notched locking structure of said door, allowing said door to open.

10. The mechanism of claim 9, further comprising a solenoid spring arranged on said solenoid to force said latch arm into a latched position when said solenoid is not activated.

11. A method of operating a coin-controlled latching mechanism arranged to interface with a door locking structure, said latching mechanism including a coin detector and a latching arm and deactivating arm on the common pivot, said method comprising the steps of:

(a) detecting for a predetermined coin value;

(b) immediately responsive to step (a), operating said solenoid to raise said latching arm and release said locking structure;

(c) immediately responsive to step (b) opening said door;

(d) immediately responsive to step (c) simultaneously executing the following substeps:

(i) moving said deactivating arm on said pivot, (ii) immediately responsive to substep (i), operating a magnetic switch, (iii) immediately responsive to substep (ii), deactivating said solenoid;

(iv) immediately responsive to substep (iii), rotating said latching arm on said pivot into a locking position, (v) immediately responsive to substep (i) releasing coins from a temporary coin receptacle into a permanent coin holder.

12. The method of claim 11, wherein substep (v) comprises the following additional substeps:

(1) immediately responsive to (i), releasing tension on a spring between said deactivating arm and a hinged flap thereby allowing coin weight on said hinged flap to move said hinged flap, precipitating said coins into said permanent coin holder.

13. The method of claim 12, further comprising the steps of:

(e) closing said door;

(f) immediately responsive to step (f) moving said deactivating arm to an original position commensurate with a closed door;

(g) immediately responsive to step (f) operating a switch to permit activation of said solenoid; and, (h) immediately responsive to step (f), exerting spring bias to close said hinged flap thereby maintaining coins in a temporary coin receptacle formed by said hinged flap.

* * * * *